US005407495A

United States Patent [19]

Rohatgi

[11] Patent Number: 5,407,495

[45] Date of Patent: Apr. 18, 1995

[54] THERMAL MANAGEMENT OF FIBERS AND PARTICLES IN COMPOSITES

[75] Inventor: Pradeep K. Rohatgi, Whitefish Bay, Wis.

[73] Assignee: Board of Regents of the University of Wisconsin System on behalf of the University of Wisconsin-Milwaukee, Milwaukee, Wis.

[21] Appl. No.: 126,076

[22] Filed: Sep. 22, 1993

[51] Int. Cl.[6] ..... B22D 19/02

[52] U.S. Cl. ..... 148/522; 148/523; 148/525; 148/538; 164/98

[58] Field of Search ..... 148/522, 523, 525, 538, 148/549; 420/590; 164/98

[56] References Cited

U.S. PATENT DOCUMENTS

| | | | |
|---|---|---|---|
| 4,444,603 | 4/1984 | Yamatsuta et al. | 148/549 |
| 4,452,865 | 6/1984 | Yamatsuta et al. | 148/549 |
| 4,669,523 | 6/1987 | Sabatie et al. | 164/98 |
| 4,751,048 | 6/1988 | Christodoulou et al. | 420/590 |
| 4,772,452 | 9/1988 | Brupbacher et al. | 420/590 |
| 4,852,630 | 8/1989 | Hamajima et al. | 164/98 |
| 5,167,271 | 12/1992 | Lange et al. | 164/98 |
| 5,199,481 | 4/1993 | Corwin et al. | 164/98 |

*Primary Examiner*—George Wyszomierski
*Attorney, Agent, or Firm*—Irving D. Ross, Jr.

[57] ABSTRACT

A metal matrix composite consisting of aluminum silicon alloy reinforced with graphite fibers exhibits improved mechanical and physical properties when the graphite fibers are subjected to external cooling.

10 Claims, 12 Drawing Sheets

150X

180X

GRAPHITE PENCIL

THERMAL MANAGEMENT OF FIBERS AND PARTICLES IN COMPOSITES

ORIGIN OF INVENTION

This invention was made with U.S. Government support under Office of Naval Research (ONR) Grant N00014-90-J-4139. The U.S. Government has certain rights in this invention.

FIELD OF INVENTION

This invention relates in general to the reinforcement of molten materials where the resulting composite consists of metal, ceramic, or polymer matrix and the reinforcing material is either metallic or ceramic.

BACKGROUND OF THE INVENTION

Metal matrix composites consist of a wide array of microstructures. These composites either consist of a metallic or an intermetallic compound as the contiguous matrix. Usually the reinforcing material consists of a ceramic; however, a refractory metal is sometimes used. Reinforcing material may be in the form of particulates, wiskers, or discrete fibers either continuous, long or short The reinforcing material can be consolidated as porous preforms in certain cases to facilitate the formation of the composite.

Observations of cast microstructures of metal matrix particulate composites (MMC), such as Al—Si—SiC, Al—Si—$Al_2O_3$ and Al—Si—Gr indicate that during solidification, the particulates or fibers tend to segregate at the boundaries of proeutectic $\alpha$ Al dendrites instead of being engulfed within the body of growing dentrites. This phenomenon produces a nonuniform distribution of reinforcements in the matrix, and prevents the realization of the full potential of properties of cast metal matrix composites.

In an effort to improve the distribution of reinforcements and to understand the segregation phenomenon, significant amount of research has been conducted by several investigators. In general, most of the experimental results and suggested theories fall into two classes, namely, (a) Unfavorable thermodynamic conditions for the nucleation of aluminum phase on dispersoids and their engulfment by the growing primary aluminum phase.

(b) Pushing of particles by the solidifying $\alpha$ aluminum dendrites into the last freezing interdendritic regions.

The absence of nucleation of aluminum on the surface of the reinforcement (heterogeneous nucleation) may result from differences in surface and interfacial energies of the particles and the solidifying phase, as well as from possible differences in temperatures between the solidifying liquid in the immediate vicinity of a particle, and that of the particle surface itself. The differences in temperature between these solidifying liquid and the particulates may be small, and yet finite. These temperature differences between the particles and the liquid around the particles can result from the differences of thermal properties of aluminum and the ceramic reinforcements over the temperature range during which solidification takes place. Variation in thermal conductivity of some ceramic reinforcements as a function of temperature is shown in FIG. 1. Typical thermal properties of the Al—Si alloy and selected reinforcements are given in Table 1 indicating significant differences in thermal diffusivity and heat diffusivity of the matrix alloys and the reinforcements.

In an effort to illustrate the possible role of differences in temperature between the particles and the melt on solidification microstructures in cast composites, observations of solidification microstructures around larger diameter graphite tubes were made when the surface temperatures of the tubes were controlled by internal means. As a first step Al—Si alloy was solidified around tubes, rods and of graphite fibers. The influence of changes in thermal conditions of the graphite tubes, rods and fibers surfaces on the solidification microstructure of Al—Si alloys has been examined. Mechanical properties of fiber reinforced tensile samples were measured for samples where the fibers were cooled during solidification, to illustrate the influence of cooling of fibers on mechanical properties.

SUMMARY OF THE INVENTION

In a composite it is possible to measure and manipulate temperatures on relatively larger continuous surfaces of the reinforcing ceramics, for example, graphite narrow tubes, thin rods or even fibers, by forced cooling and then analyzing the adjoining microstructure. In this manner, the nucleation and growth morphologies of aluminum alloys of general interest, namely, Al—Si and Al—Cu systems can be altered and inference drawn from the observations can be used to analyze and alter the observed microstructure of cast MMCs even those containing particles.

Several experiments were carried out using graphite as the ceramic medium and using an Al-4.5% Si hypoeutectic alloy and an Al-8.9% Cu hypoeutectic alloy as solidifying matrices. The graphite materials used were as follows:

1. Graphite tube, commercial quality, 3 mm ID 6 mm OD
2. Graphite (pencil) leads 0.6, 0.7 and 0.9 mm in diameter
3. Graphite fiber tows coated with nickel Thermal management (external cooling) of graphite tube was achieved by passing argon, which is at ambient temperature, through the central cavity in the tube held in the melt. In the case of graphite pencil and fibers, portions of graphite pencils and fibers extending outside the composites were dipped in water while the other end was held inside the solidifying bath. Schematic diagrams of these experiments are shown in FIG. 2. In the case of fibers, to ensure complete wetting of each strand of fiber by molten metal, a small cylindrical metal casting with fibers extending outside the casting, as shown in FIG. 3, was produced by squeeze pressure infiltration technique. This cast metal-fiber piece was remelted, and the metal bath allowed to solidify while the portion of the fibers extending outside the composite was cooled in water. In each case, temperatures were carefully monitored at different locations.

As a first step, a graphite tensometer sample mold was machined. Nickel-coated graphite fibers of known weight were positioned centrally in the hollow mold before squeeze casting molten metal between the fibers. At one end of the tensile mold, a graphite fiber knot was made to secure it in the mold.

Squeeze casting of the tensile sample was carried out by keeping the graphite mold containing graphite fiber tensile assembly in another preheated graphite mold into which liquid metal was poured and squeezed using a plunger. The entire operation is schematically shown in FIG. 4.

The squeeze cast tensile sample was removed through the larger mold and remelted. After remelting, the specimen inside the tensometer mold was allowed to solidify in air while the ends of the fibers extending outside the composite were externally cooled by dipping the ends in a water bath. The tensile sample containing fibers was taken out by destroying the mold. A tensometer machine was used to pull the sample. Tensile strength, elongation and Young's modulus were determined.

FIG. 5 (*a,b,c*) shows the solidification microstructures of aluminum 4.5% Si alloy adjacent to 6 mm diameter graphite tube when the tube is (a) totally encapsulated within the solidifying alloy, (b) when a portion of the tube is exposed to atmosphere and (c) when the tube (surrounded by solidifying alloy) is cooled by passing argon through its inside diameter. It is evident from the figure that when the graphite tube is totally encapsulated inside the solidifying liquid, the cast microstructure in contact with the outer surface of the graphite tube is primarily Al—Si eutectic. α aluminum dendrites have nucleated away from the surface of the graphite tube and apparently the last freezing interdendritic liquid has solidified as Al—Si eutectic. This enhances the volume fraction of silicon in contact with graphite reinforcement. When a part of the graphite tube is exposed to air, the amount of α aluminum dendrite growing on the graphite tube has increased. The increase in amount of α aluminum growing on the surface of the graphite tube is presumably due to lowering of surface temperature of graphite as part of the graphite tube is exposed to air, which cools the liquid near its surface. A striking difference in the structure of solidified alloy in contact with the outer diameter of graphite tube was observed when the tube was externally cooled by passing argon through the inner diameter. This is illustrated in 5(*c*). It may be observed that because of enhanced heat extraction through the wall and perpendicular to it, primary α aluminum dendrites have apparently nucleated and grown virtually at right angles to the outer surface of the graphite tube. The eutectic phase outlines the alpha-dendrites and was the last to solidify. Virtual absence of any silicon eutectic phase at the graphite surface is a striking feature to note. The fraction of α-graphite interface is higher in this type of structure and the fraction of Si-graphite interface is lower.

In contrast, FIG. 6 shows the microstructure of the same alloy on the outside diameter of graphite tube, when the graphite tube was heated to maintain the outside diameter graphite surface, inside the solidifying melt, at a temperature relatively higher than the melt temperature close to it. It is evident from FIG. 6 that the microstructure shows a predominance of Al—Si eutectic on the graphite surface, and an absence of oriented α Al dendrite as seen in FIG. 5. It is surmised that by maintaining a slightly higher temperature on the surface of the graphite tube than the temperature of the melt away from it, any primary α aluminum phase can be prevented from nucleating in its surface; instead α aluminum nucleates away from the hotter graphite surface. Only when the overall temperature had decreased further will the Si enriched melt layer close to the graphite surface solidify as an Al—Si eutectic on the graphite surface. The thermal management techniques employed in this study were able to control the temperature of the surface of graphite tube at levels both higher and lower than the molten melt in contact with the surface of the graphite.

FIG. 7 shows the microstructure of aluminum-copper alloy (8.9% Cu) on the surfaces of graphite tube which was externally cooled by passing argon through the interior of the tubes. The structure clearly indicates that by keeping the graphite surface at a lower temperature, only primary α aluminum rendrites formed on the surface of the graphite, and the eutectic formed farther away from the surface.

Using graphite pencils, a similar microstructural pattern is noted, as shown in FIGS. 8(*a*) and (*b*). The graphite pencils are not composed entirely of graphite (it has lime in it) and the thermal properties are different from that of a 100% graphite materials. When the alloy was cooled while the pencil is totally encapsulated by the alloy, it is surrounded by Al—Cu eutectic as illustrated in FIG. 8(*a*) whereas when the pencil is externally cooled, the surface of the pencil is completed surrounded by α aluminum dendrites which apparently have nucleated and grown on its surface FIG. 8(*b*).

Further, in order to study the influence of variation in diameter of reinforcement on thermal effects, and subsequently on nucleation, nickel coated graphite fibers were used to carry out similar experiments. The graphite fibers were externally cooled by keeping the ends of graphite fibers, extending out of the solidifying metal, immersed in ice-cold water. FIG. 9 shows a typical micrograph showing α aluminum alpha-phase dendrites forming almost perpendicularly to the tow of the graphite fibers. Again hardly any eutectic structure is noted near the surface. The striking difference between the microstructures, when fibers are (a) cooled and (b) not cooled, is illustrated in FIG. 10. It is clear that when fibers are not cooled, the structure exhibits more eutectic silicon around the fibers.

From the squeeze casting experiments three different types of tensile samples were obtained and tested. These are:

(a) As squeeze cast without remelting.
(b) Squeeze cast, remelted and solidified while the ends of fiber extending outside the composite were water cooled.

Tensile results of these three different conditions are given in FIG. 11(*a,b*).

FIG. 11(*a*) shows the variation in tensile strength with different volume fraction of graphite fibers. The data shows that when the fibers were cooled (RWC) the composite exhibits the highest strength for any given fiber volume fraction. As noted earlier, by cooling the fiber ends, the sample microstructure around the fiber was modified leading to a greater volume fraction α aluminum in contact with fibers surface, which in turn leads to an increase in the tensile strength of the sample. In the present case, it may be speculated that grain size around the fiber might have been reduced by faster cooling and the proportion of eutectic silicon and α aluminum might have changed.

FIG. 11 shows the variation in elastic modulus for different volume fraction of fiber. Highest elastic modulus values were obtained when the ends of the fibers extending outside the casting were water cooled. The modulus values under these conditions were closer to the theoretical values.

The invention involves thermal management of reinforcements during processing of composites. This process is applicable to any matrix including metals, alloys, intermetallics, ceramics, and polymers; in all these matrix materials the cooling of the reinforcements like graphite, silicon carbide, alumina and the ceramics, metals, and polymers will lead to a change in the structure and properties of the interface and the matrix both near the interface,and some distance way from the interface. Similar changes in the interface structure and the matrix will occur with other metal, alloy, intermetallic, ceramic, and polymer matrices.

The cooling of the reinforcement can also be applied to particle reinforcements. The particles will be in the form of a preform in contact with each other. A portion or portions of this preform can extend outside of the mold and the extended ends can be cooled. The heat extracted from the ends will increase the cooling rate of the matrix in contact with the reinforcements within the mold leading to beneficial changes in the nature of the interface and the matrix microstructure.

*a*. graphite tube completely encapsulated by liquid metal

*b*. graphite tube is cooled by passing argon

*c*. graphite pencil cooled by dipping one end in water

Figure 1:
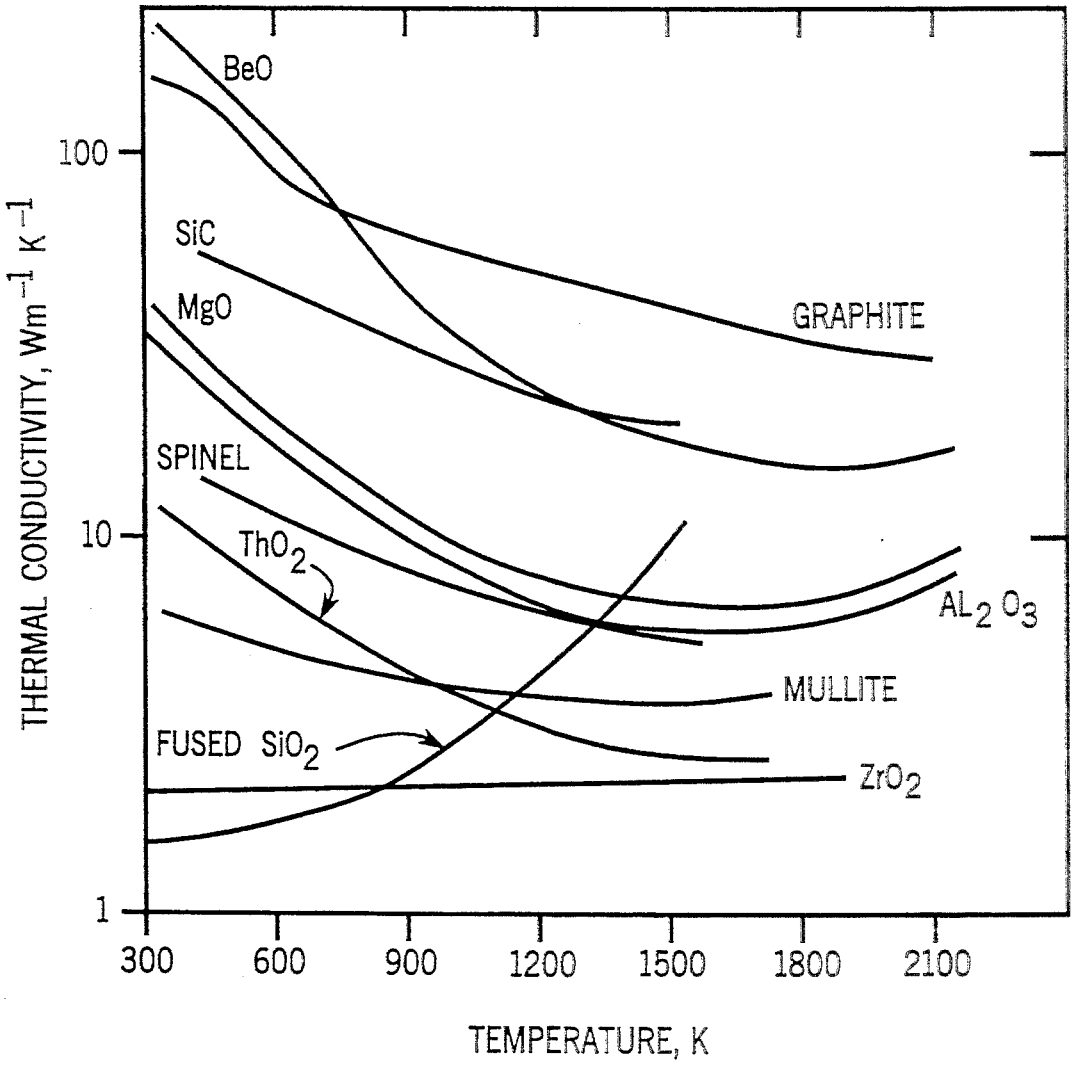
FIG. 1. Variation in thermal conductivities of ceramic reinforcements as a function of temperature FIG. 2. Schematic diagram showing thermal management experiments
Figure 2A:
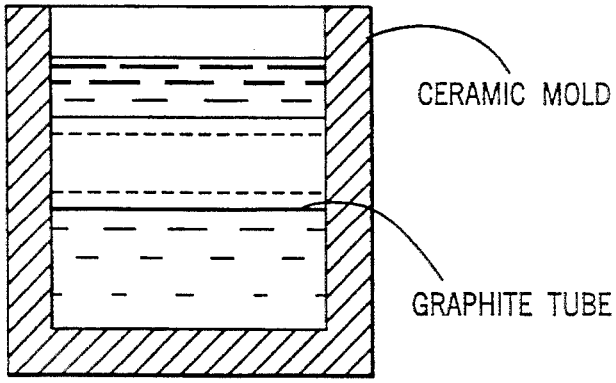
Figure 2B:
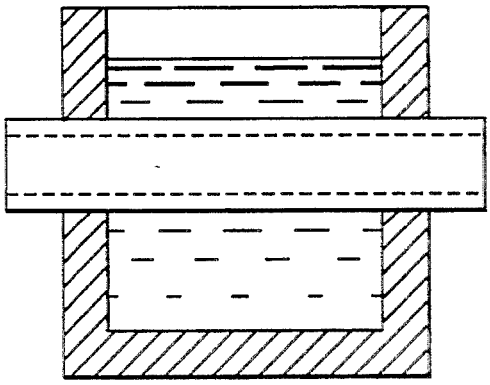
Figure 2C:
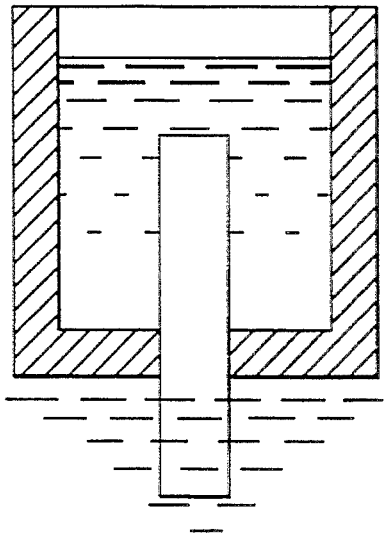
Figure 3:
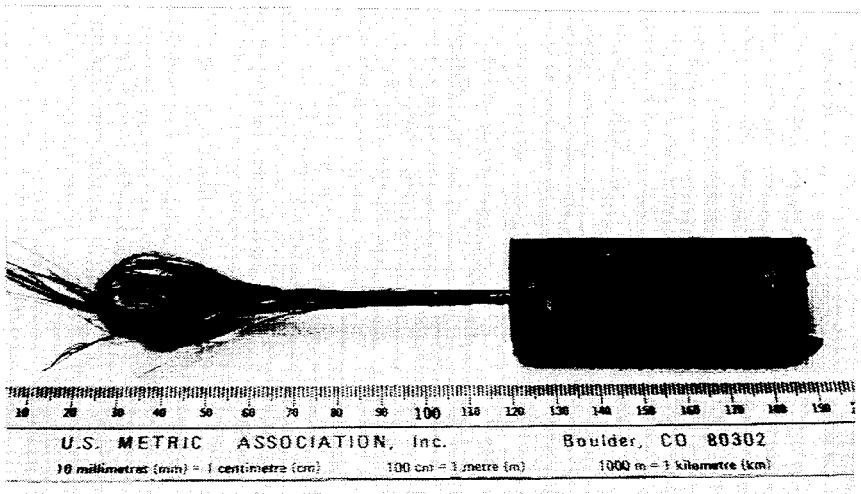
Figure 4:
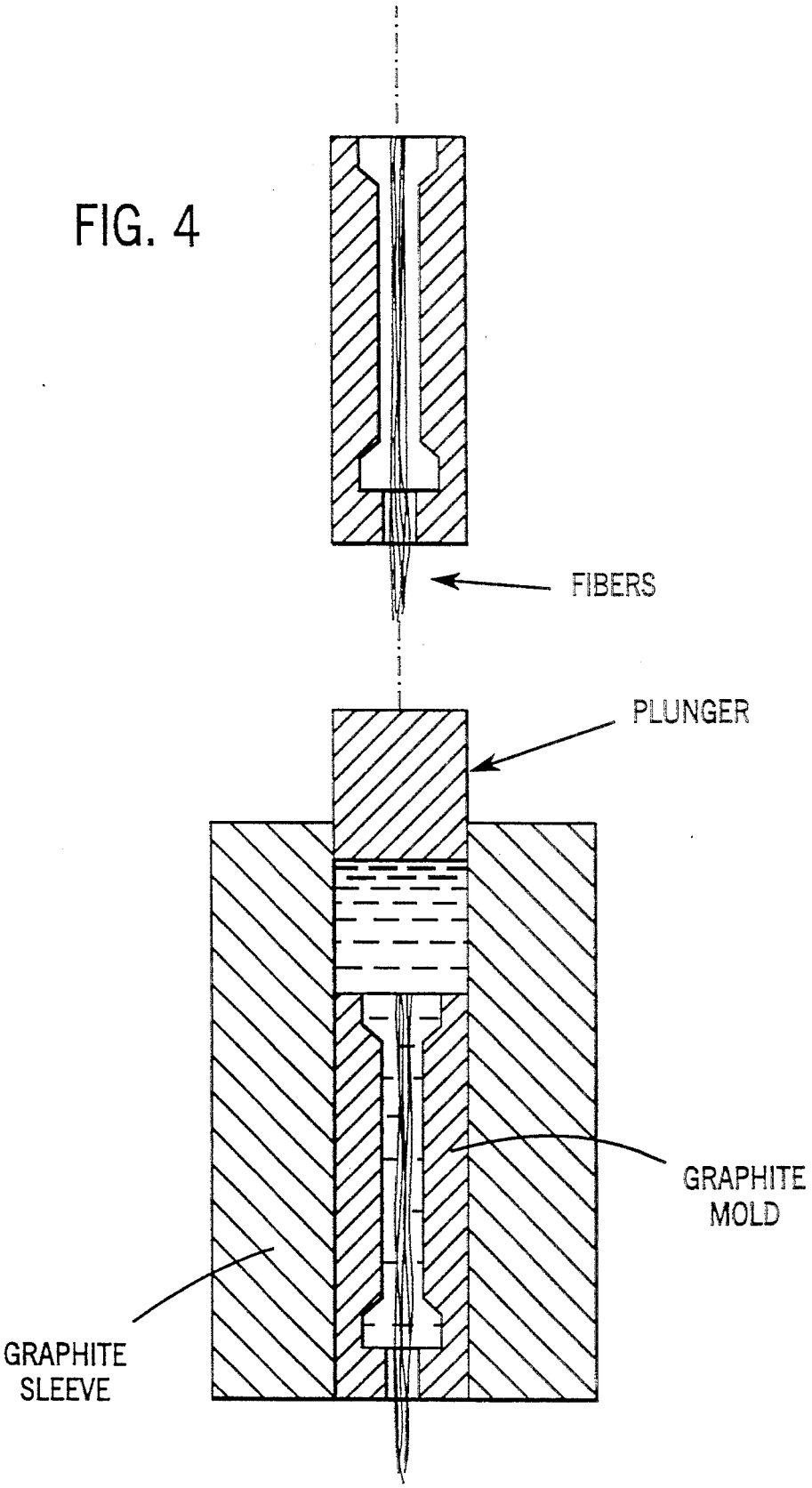
Figure 5A:
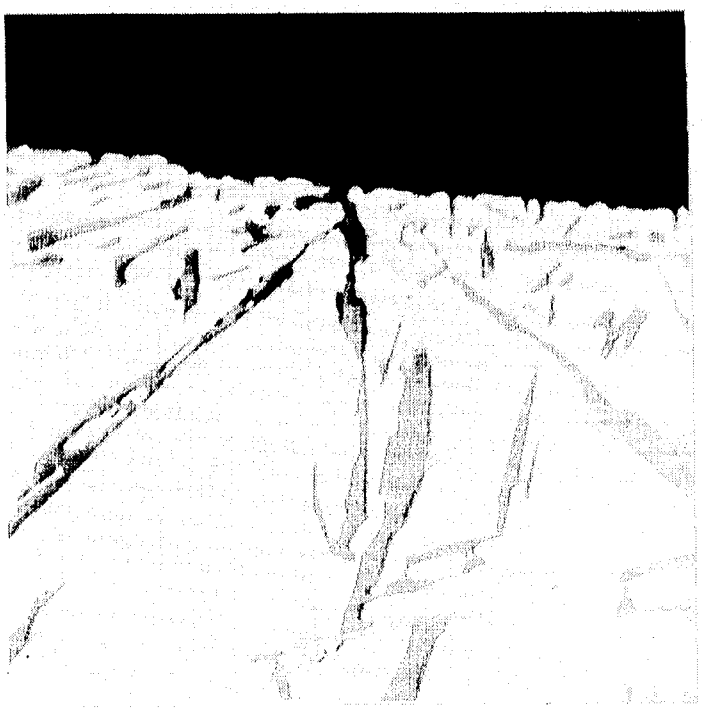
Figure 5B:
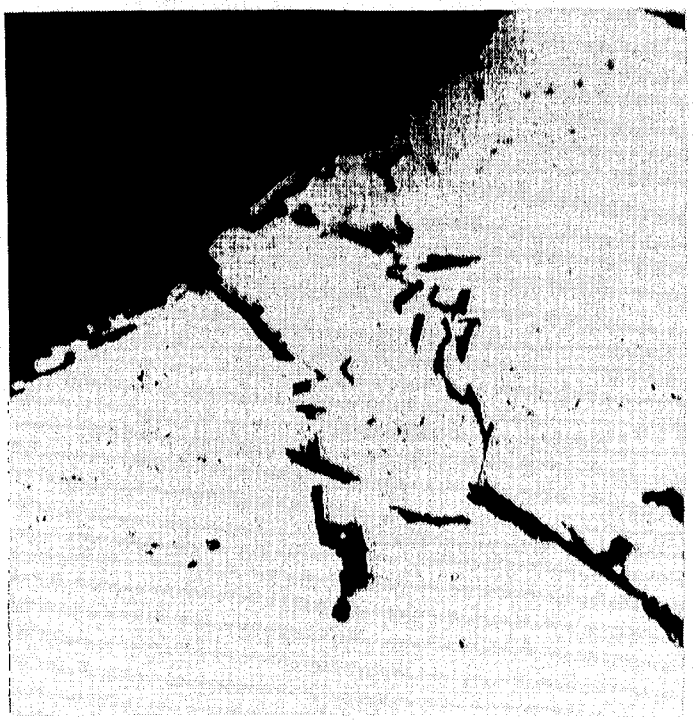
Figure 5C:
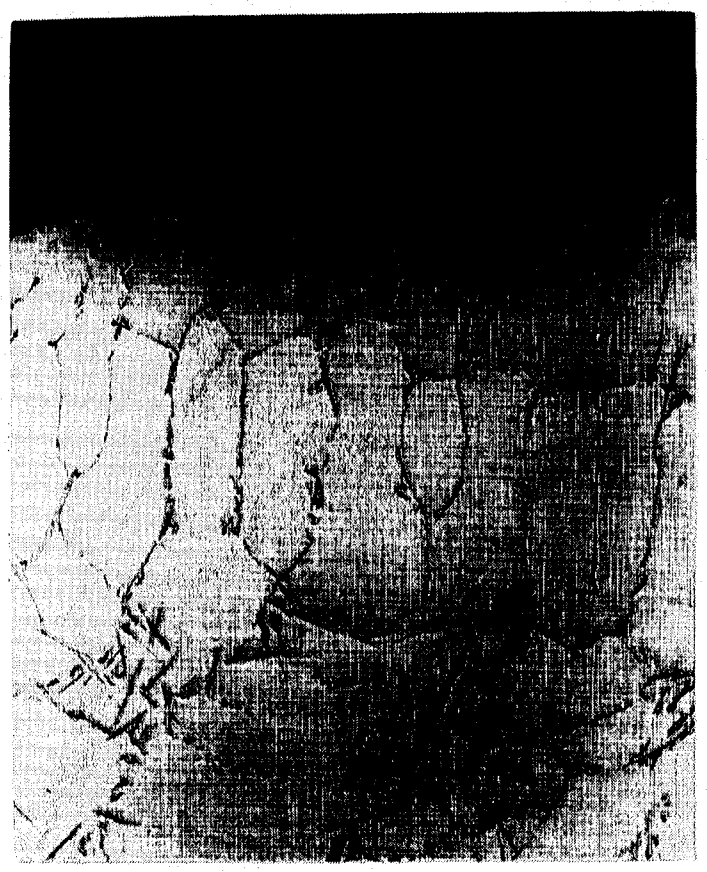

FIG. 3. A cylindrical aluminum alloy casting with fibers extending out at one end FIG. 4. Schematic diagram showing preparation of squeeze pressure infiltrated tensometer samples FIG. 5. Solidification microstructure of Al-4.5% Si alloy

*a*. when 6 mm diameter graphite tube is completely encapsulated by liquid alloy

*b*. when portion of the tube is exposed to air

*c*. when the tube is cooled by passing argon through the inner diameter

Figure 6:
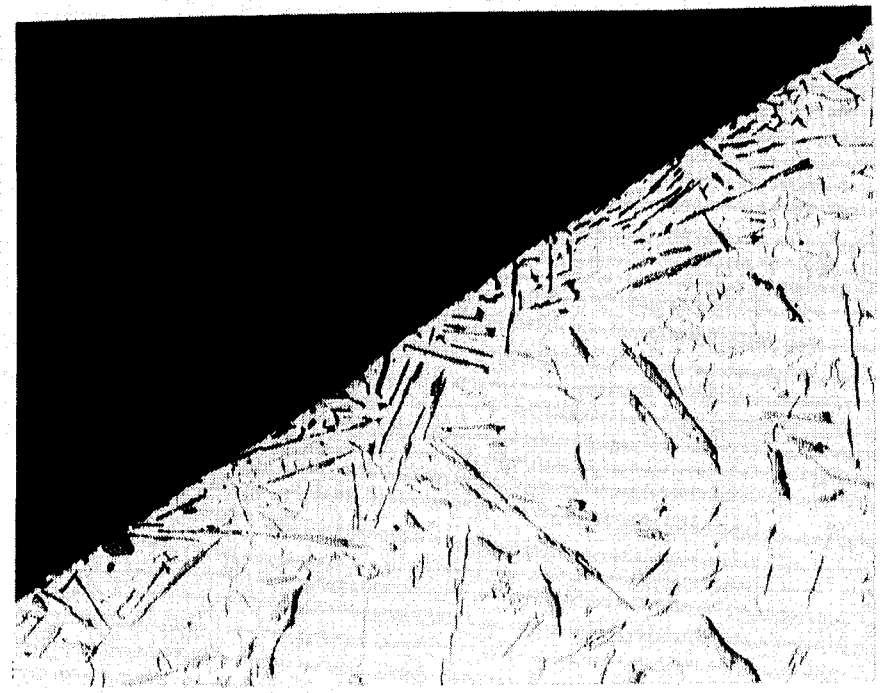
Figure 7:
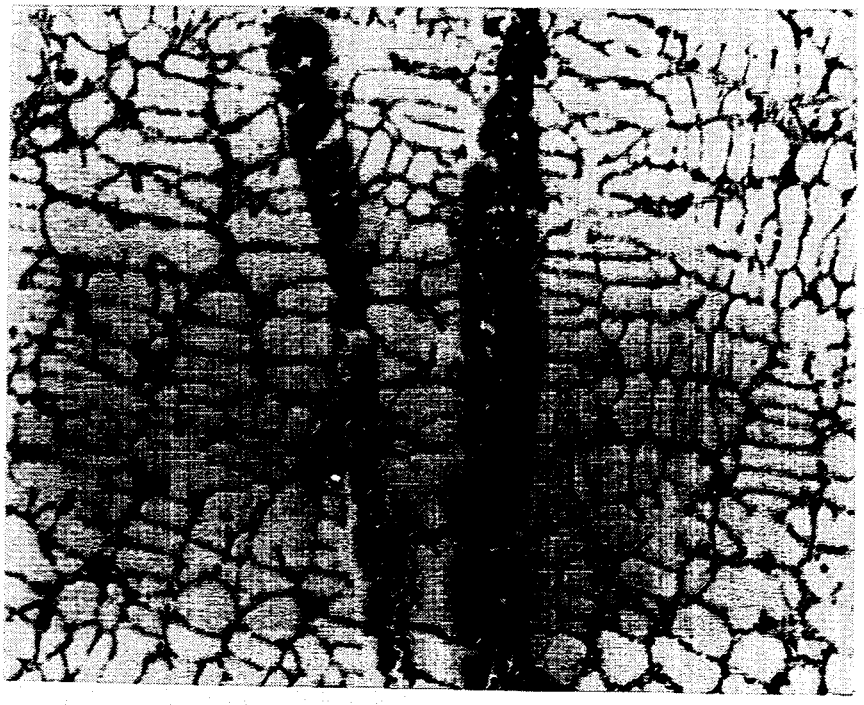
Figure 8A:
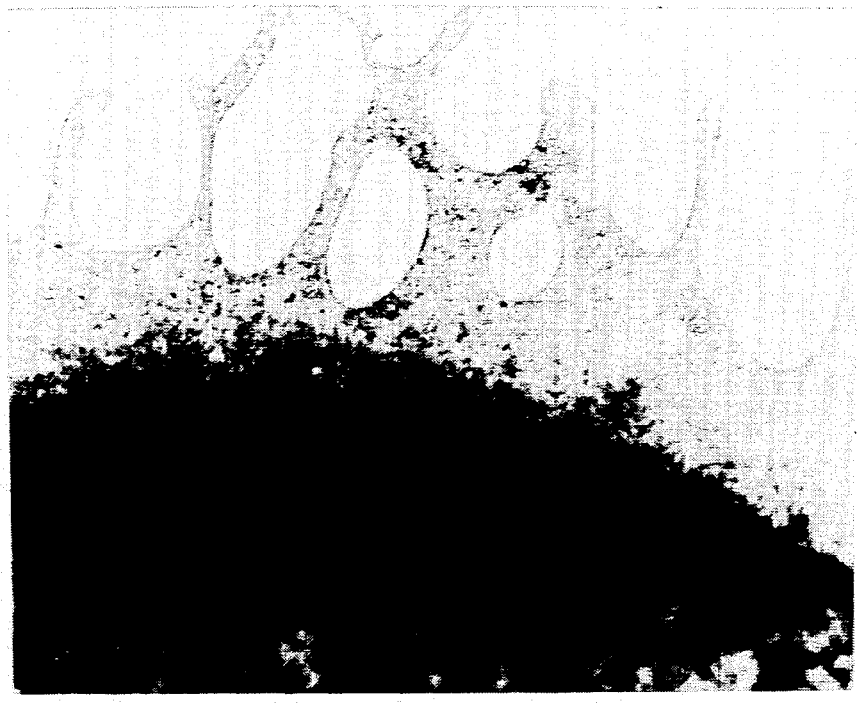
Figure 8B:
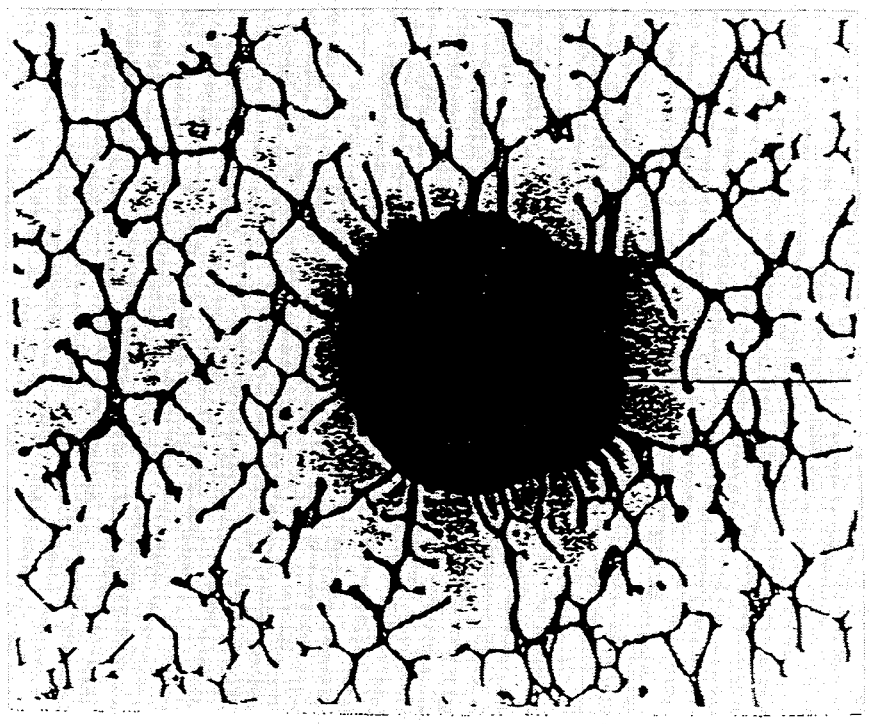

FIG. 6. Solidification microstructure of Al-4.5% Si alloy when graphite tube is heated externally to maintain surface temperature of the tube at high temperature FIG. 7. Nucleation and growth of aluminum dendrite on thermally managed tube FIG. 8. Solidification microstructure of Al-4.5% Cu alloy

*a*. when the pencils are totally encapsulated by liquid alloy

*b*. when the pencils are externally cooled

Figure 9:
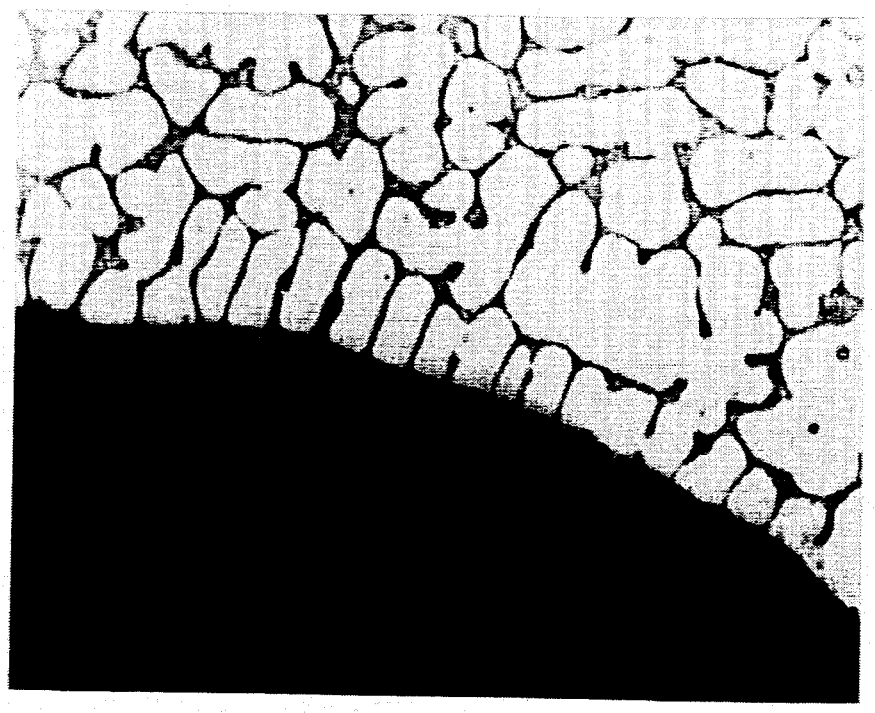

FIG. 9. Microstructure of thermally managed fiber in aluminum silicon alloy

Figure 10A:
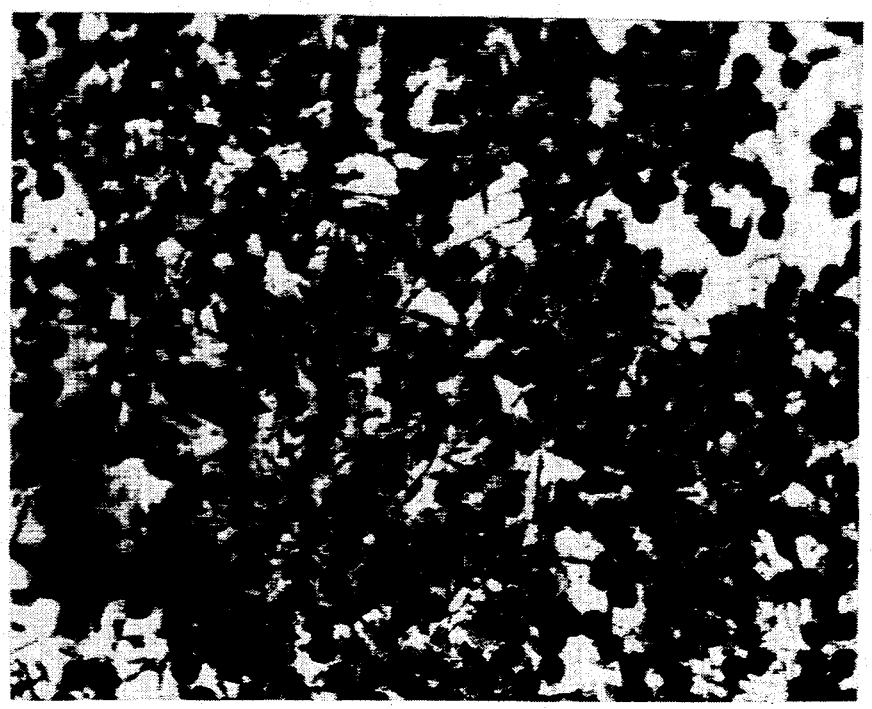
Figure 10B:
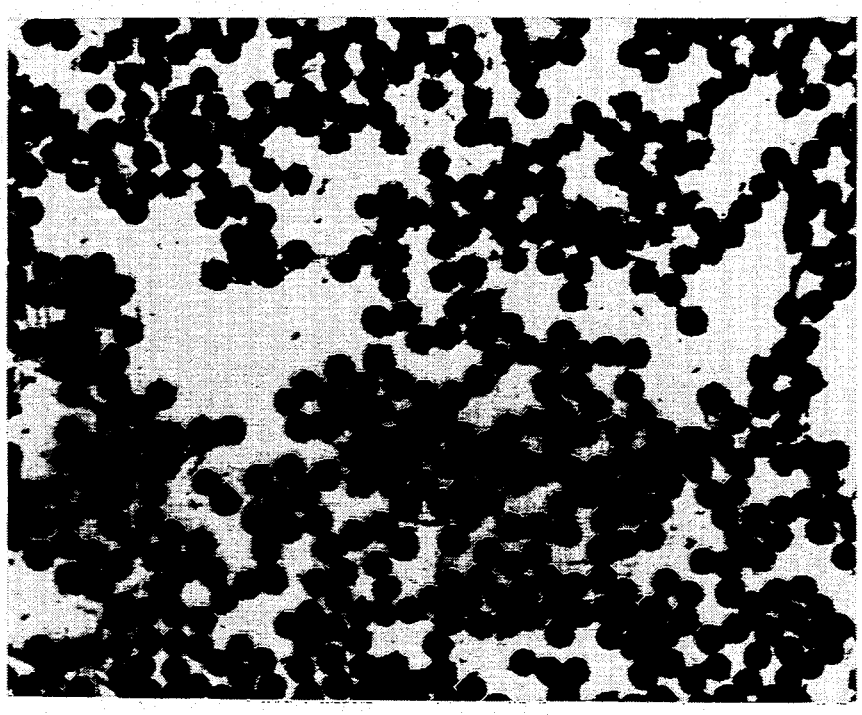

FIG. 10. Microstructure of thermally managed fiber in aluminum silicon alloy

*a*. as squeeze cast condition

*b*. when extended portion of fiber is cooled in water

Figure 11:
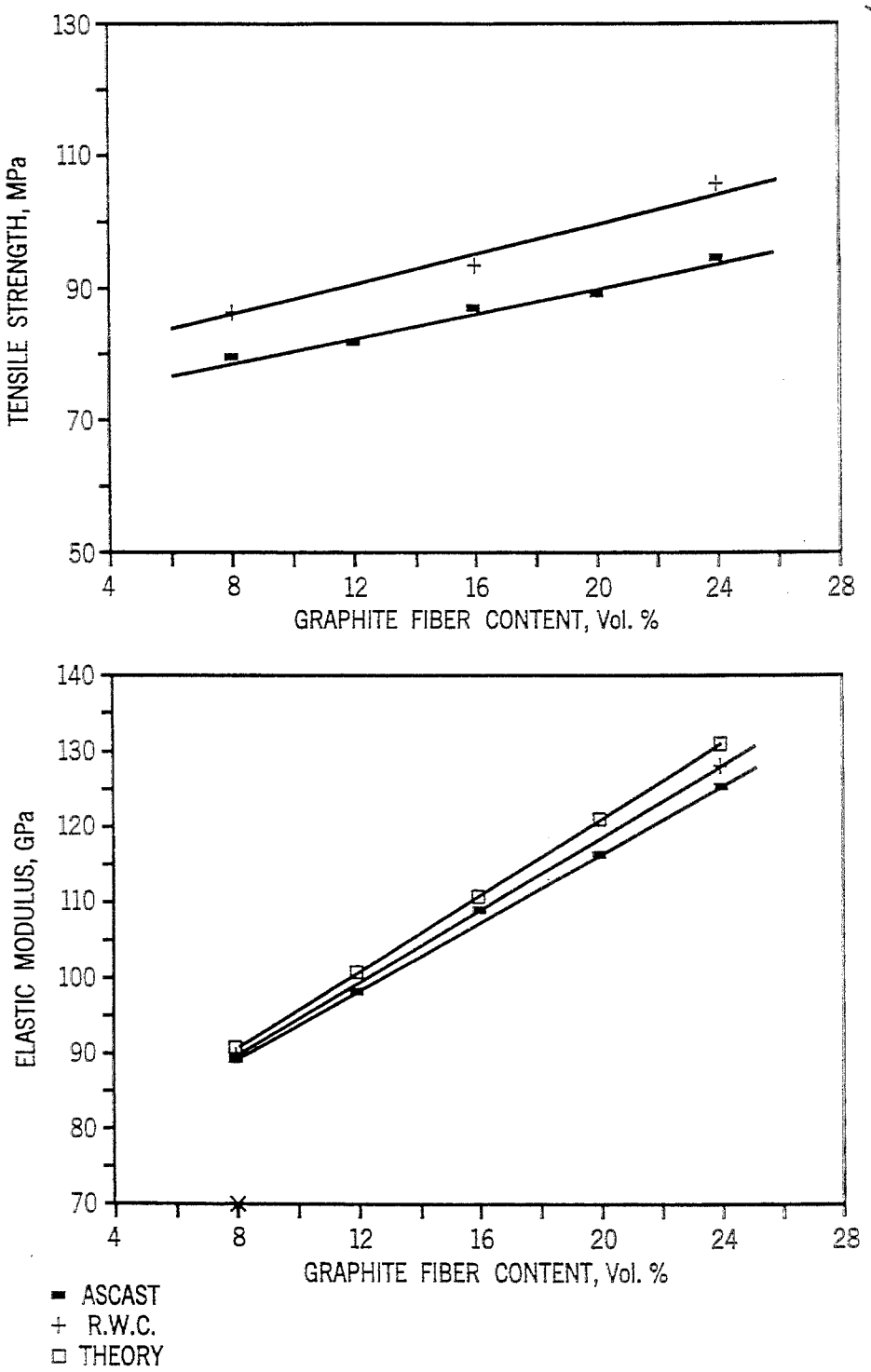

FIG. 11. Mechanical properties of thermally managed tensile samples

*a*. tensile strength

*b*. elastic moldulus

PREFERRED EMBODIMENT

A preferred embodiment would be where the fibers or particulate preform are placed in a mold in such a manner that portions of the fiber or reinforcement extend out of the mold. The matrix in a liquid form can then be poured around the fibers or particulate preform in the presence or in the absence of pressure, and the portion of reinforcements extending out of the mold are cooled while the matrix is solidifying. The pressure can be applied using a plunger or other pressurization means.

A second preferred embodiment is where a composite is initially made with a portion of reinforcement extending out of the matrix but where no thermal management has occurred. This composite can then be heated to a state where the matrix becomes liquid and then during cooling of the matrix liquid the portions of reinforcement extending out of the mold are cooled.

Thermal management of the reinforcements can be done by means other than simple heating and cooling, including the use of ultrasound, microwaves, and other eletromagnetic waves.

Thermal management can be applied to different processes of forming the matrix including solidification, powder consolidation, and vapor phase deposition.

Another advantage of cooling the reinforcements is that it reduces the extent of, or eliminates reactions between the matrix and the fibers. The thermal management of the reinforcement can also minimize or eliminate the degradation of the reinforcement which occurs when it contacts the matrix and/or the environment during processing.

The method of this invention will also be applicable to processes where the reinforcements do not necessarily extend out of the mold. In these cases external fields can be applied which heat the matrix and the reinforcement to different temperatures. An example could be a starting mixture of cold reinforcements and surrounded by a cold matrix wherein during treatment by external fields the matrix gets hotter at a higher rate than the reinforcement.

The process of this invention can also be extended to situations where the reinforcement is preferentially heated as part of thermal management, during processing. This could result in improvements in the properties of the fiber and the matrix under certain conditions. Such situations could be the formation of beneficial reaction products due to higher temperature of the reinforcement.

I claim:

1. A method to produce a composite containing reinforcing material comprising the steps of:

a) Positioning and securing a reinforcing material in and extending outside a mold;

b) Pouring a molten substance into said mold and;

c) Solidifying said molten substance while applying temperature control means to said reinforcing material to effect a temperature differential between said molten substance and said reinforcing material.

2. The method of claim 1 wherein the substance in step b) is a metal.

3. The method of claim 1 wherein step b) includes pouring the molten substance under pressure.

4. The method of claim 1 wherein said temperature control means comprises ultrasound.

5. The method of claim 1 wherein said temperature control means comprises microwaves.

6. The method of claim 1 wherein said temperature control means comprises electromagnetic waves of the appropriate wavelength so as to raise the temperature of either the molten substance or the said reinforcing material.

7. The method of claim 1 wherein step c) includes cooling of the reinforcing materials as a temperature control means.

8. The method of claim 1 wherein said reinforcing material consists of continuous fibers.

9. The method of claim 1 wherein said reinforcing material consists of particulate, discontinuous fiber or whisker preforms.

10. A method to produce a metal matrix composite containing reinforcing materials comprising the steps of:

a) reheating to a molten state a metal matrix composite with reinforcing material which extends outside of said composite; and b) solidifying said molten composite while applying temperature control means to said reinforcing material so as to effect a temperature differential between said metal matrix and said reinforcing material.

* * * * *